US006418085B2

(12) United States Patent
Terzian

(10) Patent No.: US 6,418,085 B2
(45) Date of Patent: Jul. 9, 2002

(54) FACILITATED AM/PM HOUR SETTINGS OF ENHANCED QUADRIBALANCED DIGITAL TIME DISPLAYS

(75) Inventor: Berj A. Terzian, Newbury, MA (US)

(73) Assignee: Equitime, Inc., Newbury, MA (US)

( * ) Notice: Subject to any disclaimer, the term of this patent is extended or adjusted under 35 U.S.C. 154(b) by 0 days.

(21) Appl. No.: 09/827,571

(22) Filed: Apr. 5, 2001

Related U.S. Application Data

(63) Continuation-in-part of application No. 09/679,864, filed on Oct. 5, 2000, now Pat. No. 6,286,991, which is a continuation-in-part of application No. 09/619,368, filed on Jul. 19, 2000, now Pat. No. 6,215,736, which is a continuation-in-part of application No. 09/482,479, filed on Jan. 12, 2000, now abandoned.

(51) Int. Cl.[7] ..... G04C 19/00; G04F 8/00

(52) U.S. Cl. ..... 368/82; 368/84; 368/107; 368/239

(58) Field of Search ..... 368/82–84, 69–70, 368/238–240, 107–113, 223, 187–190, 319–321

(56) References Cited

U.S. PATENT DOCUMENTS 3,874,162 A 4/1975 Boxberger et al.
3,971,012 A * 7/1976 Morokawa ..... 345/33
4,031,341 A 6/1977 Wuthrich et al.
4,092,638 A * 5/1978 Ripley ..... 368/30
4,194,352 A 3/1980 Terzian
4,209,976 A 7/1980 Flumm
4,264,966 A 4/1981 Terzian
4,270,196 A 5/1981 Terzian
4,271,497 A 6/1981 Terzian
4,483,628 A 11/1984 Terzian
4,600,316 A 7/1986 Besson
4,627,737 A 12/1986 Nance et al.
4,671,673 A 6/1987 Terzian
4,720,823 A 1/1988 Terzian'
5,343,446 A * 8/1994 Simmons ..... 368/251
5,757,730 A 5/1998 Terzian
5,805,534 A 9/1998 Terzian

* cited by examiner

*Primary Examiner*—David S. Martin
*Assistant Examiner*—Michael L. Lindinger
(74) *Attorney, Agent, or Firm*—Lucas & Just

(57) ABSTRACT

A pair of numeral "8" display elements is operative to perform dual functions in a digital time display, one, to display the values of seconds and, the other, to display an AM or PM indicator which may be separately activated for setting the correct AM or PM cycle synchronized with the hour value in the time display.

16 Claims, 5 Drawing Sheets

FACILITATED AM/PM HOUR SETTINGS OF ENHANCED QUADRIBALANCED DIGITAL TIME DISPLAYS

This application is a continuation-in-part of application Ser. No. 09/679,864, filed Oct. 5, 2000, now U.S. Pat. No. 6,286,991, which is a continuation-in-part of application Ser. No. 09/619,368, filed Jul. 19, 2000, now U.S. Pat. No. 6,215,736, which is a continuation-in-part of Ser. No. 09/482,479, filed Jan. 12, 2000, now abandoned.

BACKGROUND OF THE INVENTION

I. Field of the Invention

This invention relates to timekeeping and, more particularly, to the use of digital time displays for general purpose timekeeping, as is the practice of many individuals in performing their daily activities while watching and keeping track of the time.

II. Description of the Prior Art

Quadribalanced digital time displays are described in U.S. Pat. No. 4,271,497, the disclosure of which is incorporated herein by reference. Those displays comprise centrally positioned hour digits flanked on the right by increasing minute digits displayed in upper and lower positions relative to current hour digits during the first and second quarter hours. Thereafter, next hour digits are flanked on the left by decreasing minute digits displayed in lower and upper positions during the third and fourth quarter hours. In this way, the four quarter hours are precisely defined, balanced and visually differentiated, while elapsed and future time are viewed during the respective first and second halves of each hour.

In addition, a pair of multiple digital display elements, each comprising seven elements arranged in a numeral "8" pattern, is located below the centrally positioned hour digits in the above-described displays. That pair is operated to display 0–59 incrementing seconds during each rising minute digit of the first half hour, and to display 59-0 decrementing seconds during each falling minute digit of the second half hour.

III. Recognition of Problems in the Prior Art

The present applicant has recognized certain problems in the prior art.

The specification of U.S. Pat. No. 4,271,497 does not specifically describe and portray how the setting or resetting of the display of hours is to be synchronized with the current AM or PM cycle of any 24-hour day. Generally, conventional digital displays activate a display of an AM or PM indicator, with or without flashing, when the current hour display is activated by flashing to signal that it is capable of being set or reset to another value. Such setting or resetting is usually accomplished by operating a control, typically a push button, which scrolls the existing hour value forward, incrementally or continuously, through a set of values from 1 through 12 to permit stopping at any desired new value.

Thus, and for example, when a wristwatch or clock is to be reset back one hour, in order to switch from daylight savings to standard time, it is necessary to scroll through eleven intermediate hour values to reach the desired new hour, since the values scroll unidirectionally only in the forward direction. Similarly, to set or reset an hour display due to traveling through one or more different time zones, or because an alarm time needs to be set, scrolling through multiple hour values is again often required to reach the desired hour value.

In addition, these setting/resetting procedures involve the fact that not only does the hour value have to be correct, but it also must be synchronized to the proper AM or PM cycle of the 24-hour day. Usually, the activated AM or PM indicator can only be changed by scrolling the hour values sufficiently forward until the indicator switches from one cycle to the other, thus enabling selection of the correct AM or PM time cycle, as well as the correct hour. Accordingly, setting and resetting of digital hour values is complicated and sometimes confusing in view of the requirements imposed on the viewer by the above-described conventional procedures.

Finally, in some embodiments of enhanced quadribalanced displays disclosed in the above-cited applications, Ser. Nos. 09/679,864 and 09/619,368, there is space only in the top portions of the displays to locate and display the AM or PM indicators, which interferes with locating a symmetrically positioned alarm indicator or icon in the same space. This is also often true of conventional digital time displays which operate solely by showing 59 minutes of incremental elapsed minutes on the right side of an existing hour during each hourly cycle.

SUMMARY OF THE INVENTION

The present invention is based on the realization that the foregoing problems can be substantially alleviated or overcome by modifying the digital display elements that display seconds in a digital time display, such that they also perform a second function of displaying AM/PM indicators whenever the hours in the display have to be set or reset to a different value. By creating such dual functions for these display elements, the space otherwise occupied in the display by conventional separately located AM/PM indicators is freed for use in other ways, for example, day or month names or dates, or alarm indicators or icons. This has especially important value for the enhanced quadribalanced displays of Ser. Nos. 09/679,864 and 09/619,368 because there, seconds are displayed in a special location below centrally positioned hour displays. The capability of such elements to also provide AM/PM indicators enables using the larger empty space in the top portion of the display for presentation of other information such as, for example, symmetrically located alarm indicators, as will be illustrated and further described hereafter.

Figure 1:
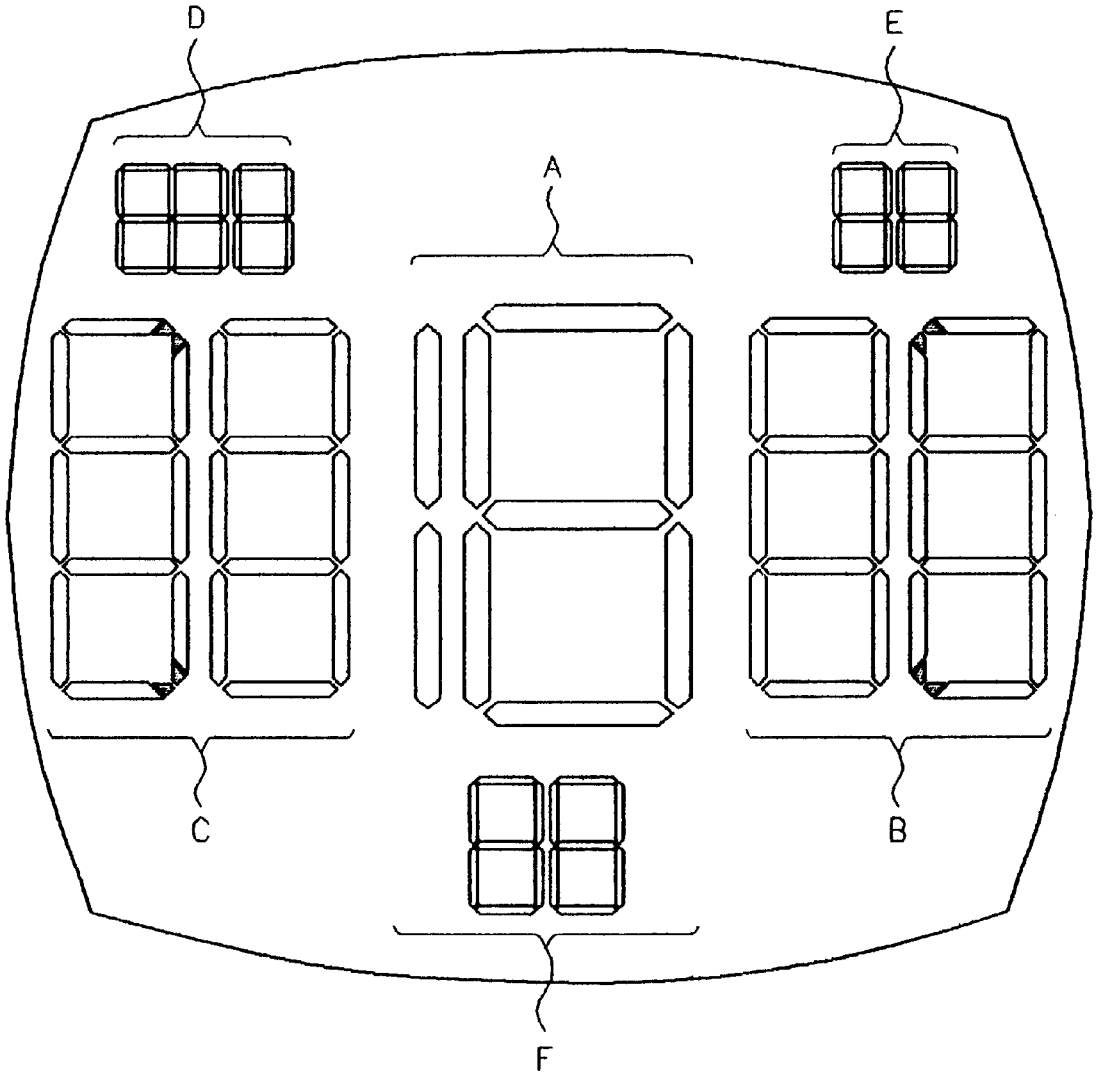
FIG. 1 is a copy of FIG. 10 of co-pending applications Ser. Nos. 09/679,864 and 09/619,368, with added brackets A–F to reference six corresponding groups of digital display elements.

Referring again to FIG. 1, it illustrates a layout of digital display elements organized in groups that enable displaying enhanced quadribalanced time, as described in the above-cited co-pending applications. Briefly, the centrally located group below bracket A is selectively activatable to display hour values of 1 through 12. The pair of ten-segmented display elements on the right, above bracket B, is selectively activatable to display increasing minutes of elapsed time past a current hour, in relatively upper and lower positions during the first and second quarter hours, by activating the uppermost and lowermost seven elements of each ten-segmented array to display respective minute values of 1–15 and 16–30 during those quarter hour periods. The complementary pair of ten-segmented display elements on the left, above bracket C, is selectively activatable to display decreasing minutes of remaining time before a next hour, in relatively lower and upper positions during the third and fourth quarter hours, by activating the lowermost and uppermost seven elements of each ten-segmented array to display respective minute values of 29-16 and 15-1 during those quarter hour periods.

The 19-segmented group of display elements located in the upper left portion of the display area, below bracket D, is selectively activatable to display abbreviated first-two-letter names of the days of the week.

The pair of numeral 8 arrays of elements located in the upper right portion of the display area, below bracket E, is selectively activatable to display the date of each day of the month.

Finally, the pair of numeral 8 arrays located in the lowest portion of the display area, above bracket F, is selectively activatable to display incrementing 0–59 seconds during each minute of the first two quarter hours of elapsed time, and decrementing 59-0 seconds during each minute of the last two quarters of remaining time.

In addition to the foregoing brief description of the quadribalanced timekeeping modes of operation, the previously cited co-pending applications provide enhancement thereof by incorporating markers which are activated to mark one or more of the three quarter hour spaces not used to display time information at a given time. This achieves certain improvements and advantages which are described in those applications. One embodiment of such markers is provided by selective activation of separate corner portions of the display elements in two of the arrays of the display groups above brackets B and C, which corners are darkened in FIG. 1 of this application.

Figure 2:
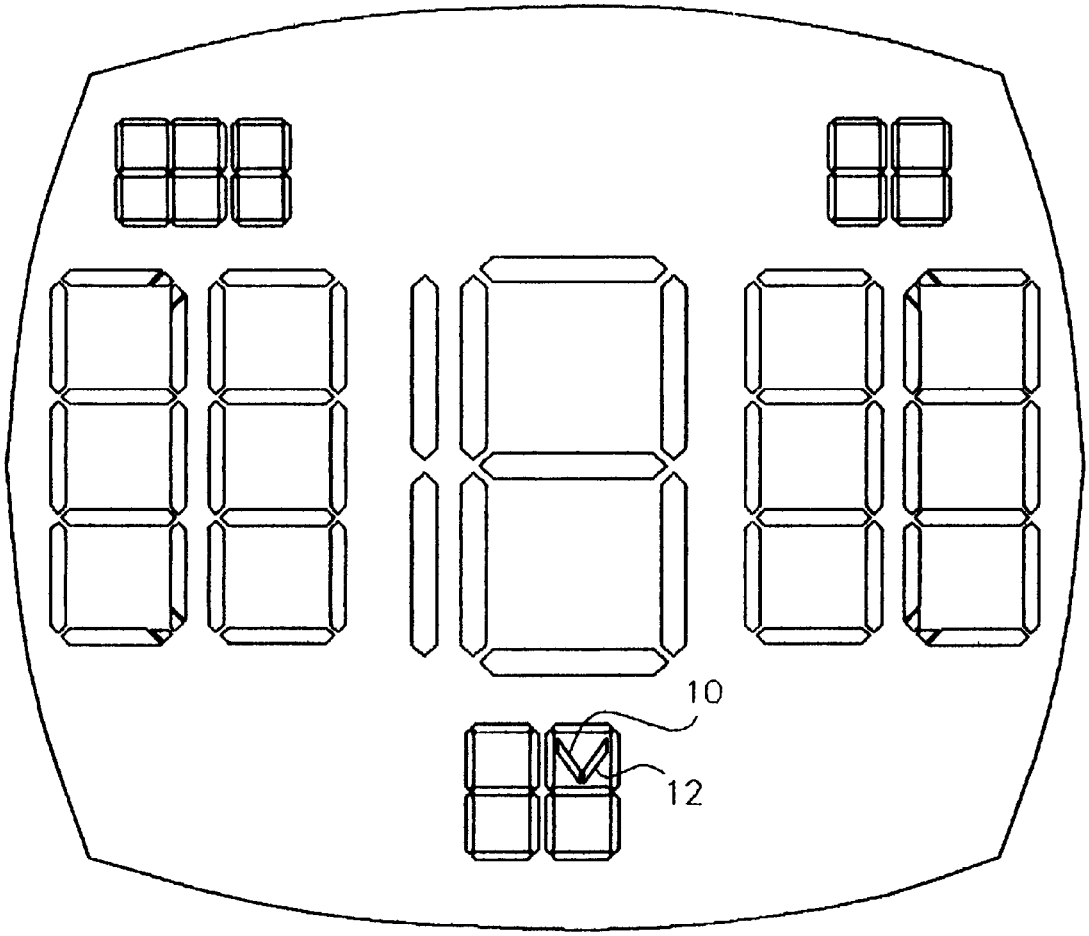
FIG. 2 is a similar view showing a modification of the display elements of bracket F.

Referring now to FIG. 2, illustrated there is the addition of two downwardly extending and converging display elements 10 and 12 to form a "V" within the upper space surrounded by the top four display elements of the numeral 8 array on the right. This modification enables the added elements to be activated, together with the four vertical elements of the array, to form a letter "M". That capability, in turn, enables selective activation of both arrays to display AM and PM indicators.

Figure 3:
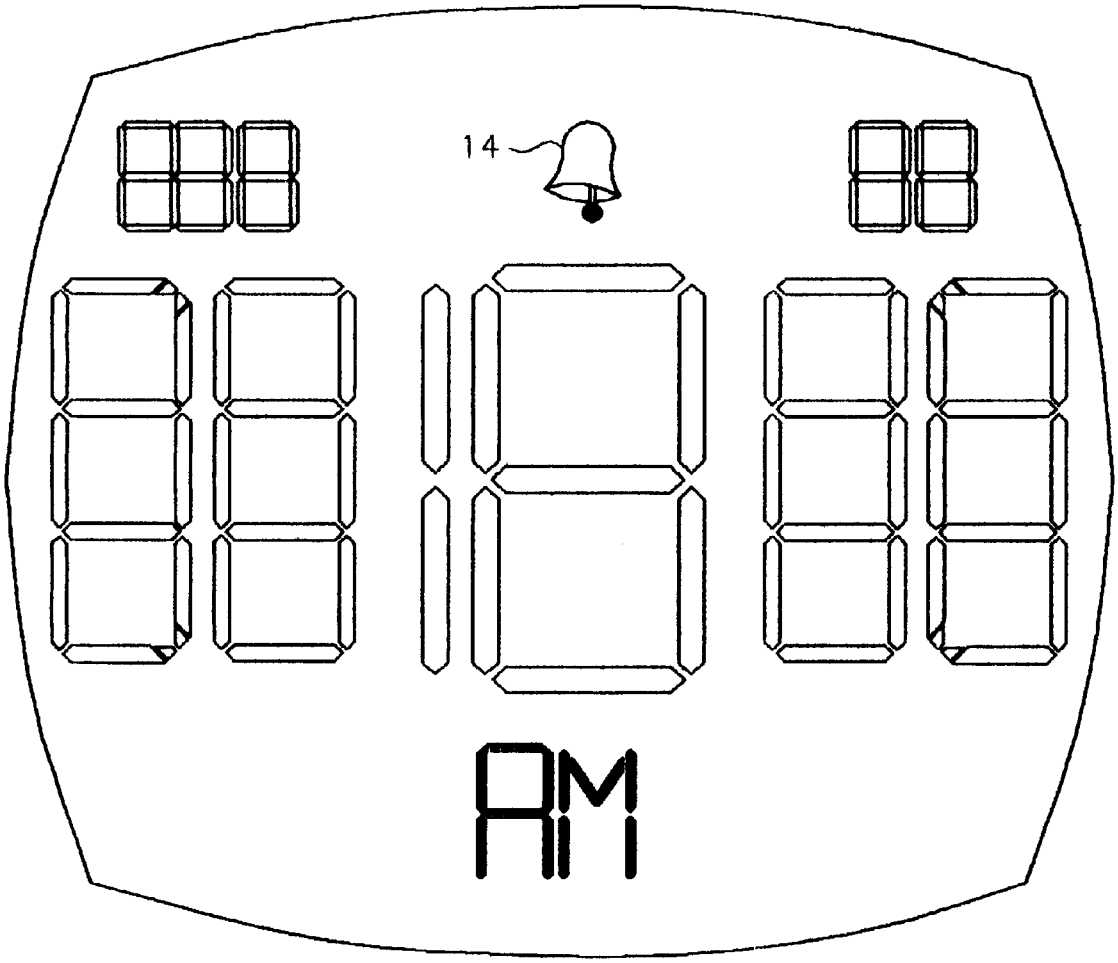
FIG. 3 is similar showing activation of such elements to display an AM indicator.

This is illustrated in FIG. 3. As shown, activation of six of the seven elements of the array on the left, with the bottommost element omitted, provides the letter "A" which, together with the "M" formed by the array on the right, provides an AM indicator in the display. As a result, the space between the display groups of brackets D and E, above the central hours display, is left available for presentation of other indicators or icons. In FIG. 3, an activated bell-shaped display element 14 is shown which signifies that an alarm has been programmed to sound at a selected future time reached in the display.

Figure 4:
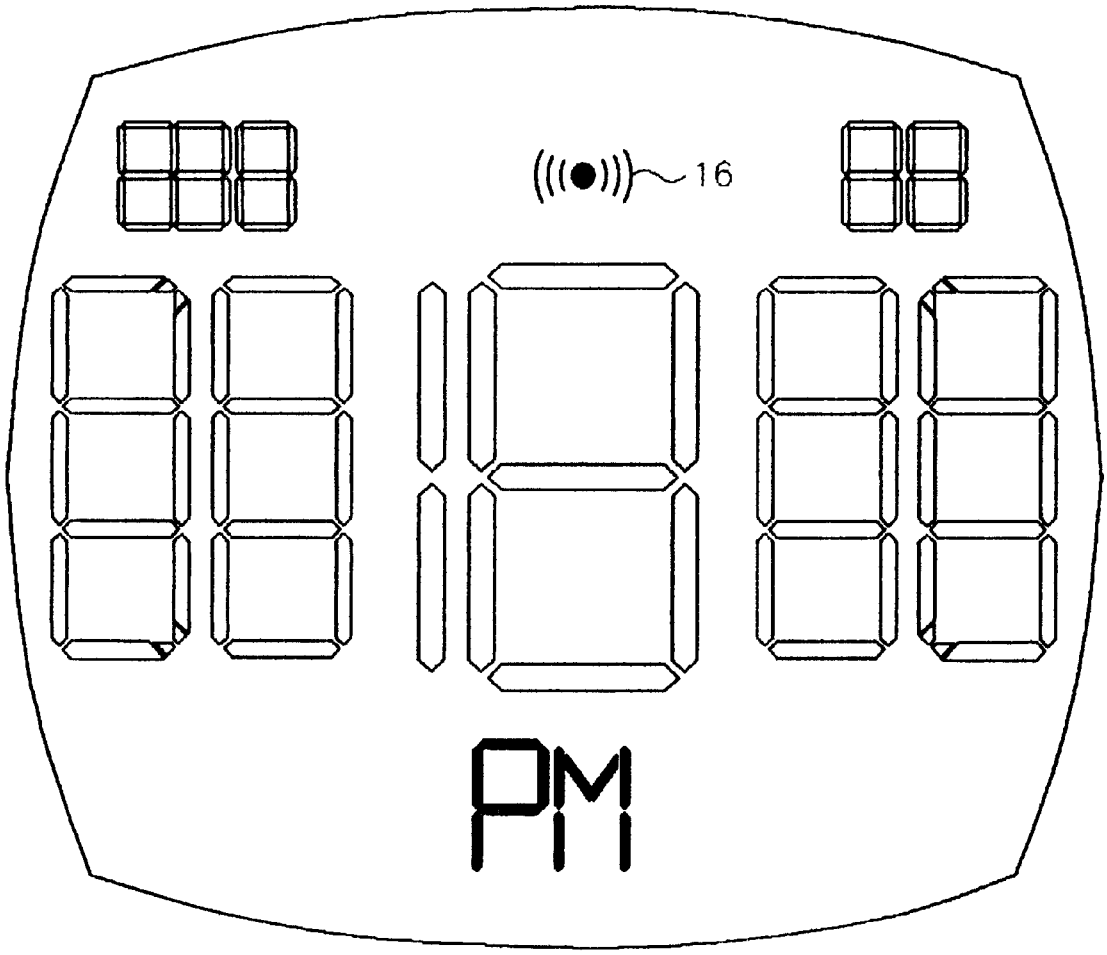
FIG. 4 is again similar showing activation of such elements to display a PM indicator.

Referring to FIG. 4, illustrated there is activation of the paired numeral 8 arrays of bracket F to form a PM indicator, the P being formed by activation of five of the seven elements of the array on the left, and the M being formed by the array on the right, as in the previous figure. Also, another set alarm indicator 16, shaped as sound waves emitted from central source, is positioned in the top space above the central hours display.

Application Ser. No. 09/674,864 describes a single crown control for operating a timepiece which displays enhanced quadribalanced time, with an included programmable alarm. In both processes of synchronizing the display to real time and setting an alarm time, the flow diagram indicates that when the hour elements are flashed for setting, the AM/PM indicators are also displayed. By incorporating the dual functioning seconds and AM/PM indicators of the present invention, that portion of the diagram and the corresponding functional sequence can be advantageously reprogrammed into separate steps.

In particular, the present invention is preferably implemented by flashing hours alone, without a simultaneous display of an AM/PM indicator, so that a viewer can concentrate and focus his or her attention solely on setting the desired hour value by scrolling just once through the range of 1 through 12. Thereafter, the next select manipulation of the crown is microprocessor controlled to initiate flashing of the AM or PM indicator, which can be followed by one or more set manipulations to switch the indicator alternately between AM and PM values.

Figure 5:
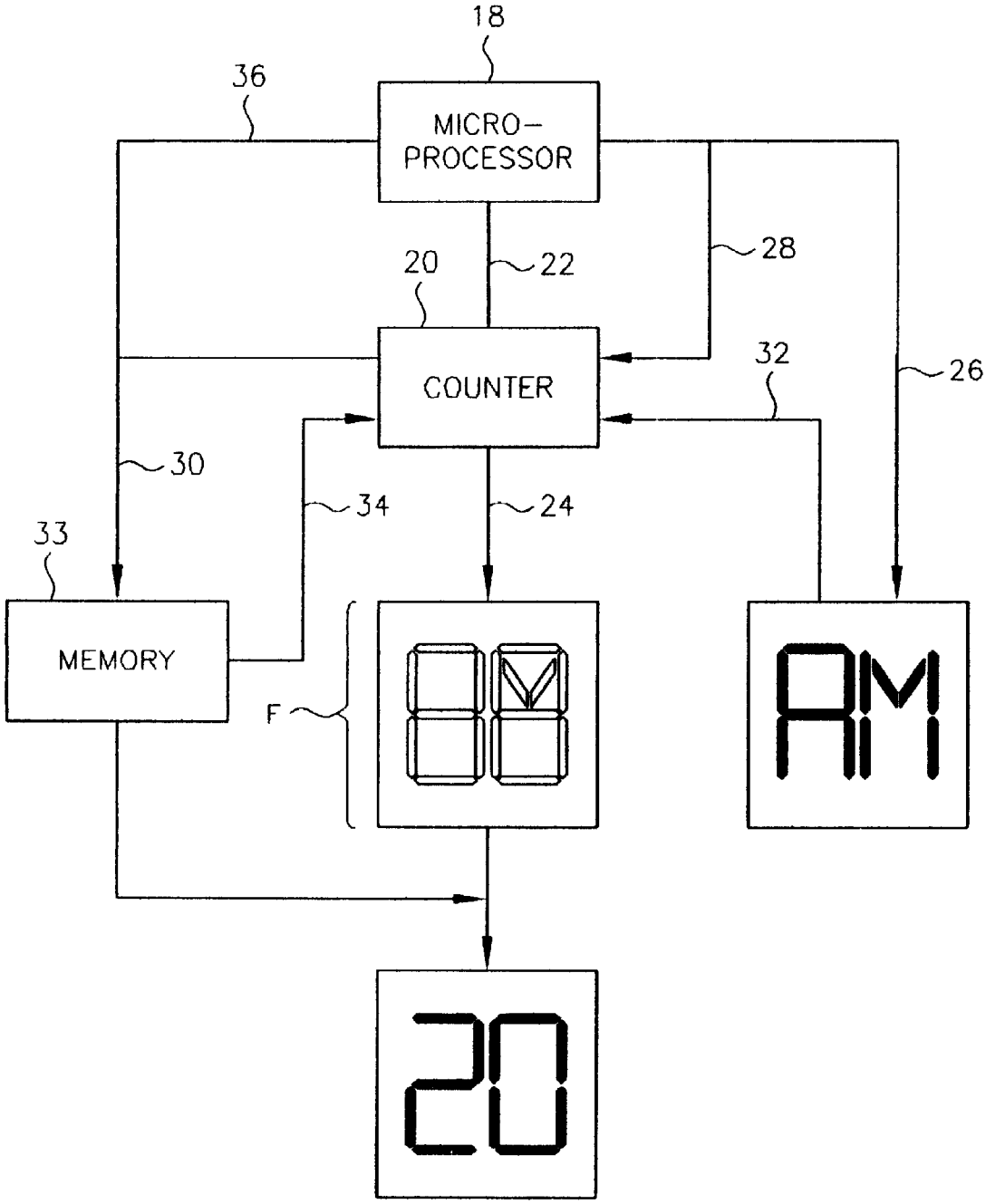
FIG. 5 is a flow diagram of a logic circuit embodiment for activating the display elements of bracket F in accordance with the present invention.

Referring to FIG. 5, illustrated there is one embodiment of a microprocessor 18 programmed to drive counter 20 to normally activate the double numeral 8 display elements of bracket F to display seconds during each minute, through leads 22 and 24. After the numerical value of hours has been set, on the next select operation, microprocessor 18 emits a control signal over lead 26 to switch the display elements of bracket F to show the last previously set AM or PM indicator (AM in this example), which begins flashing to permit it to be either switched to the other cycle by a select manipulation, or to remain as is by a set manipulation.

Simultaneously, another control signal is emitted over leads 28 and 30 to disconnect the counter output over lead 24 to the display elements of bracket F, and to switch such output to a binary counter memory unit 33, which continues to receive the counting seconds to keep accurate track of the values thereof, while the AM/PM indicators are activated for selection and setting.

Following correct setting of the AM/PM indicator, at the next select operation (to flash the day name displayed by the elements of bracket D), a response signal is sent from the AM/PM indicator circuit over lead 32 to switch the counter 20 output back over lead 24 to display seconds with the display elements of bracket F. This resumed seconds display begins with the illustrated value of "20", such being the next increment (either up or down) from the last seconds value fixed and stored in the memory unit 33, by the response signal from the AM/PM indicator transmitted over leads 32 and 30, and supplied over lead 34 to the counter 20. The memory unit 33 is thereafter cleared of all values, by a signal from microprocessor 18 over leads 36 and 30, to prepare it for the next activation of the AM/PM indicator display.

Co-pending application Ser. No. 09/679,864 describes and portrays a single pull out-push in crown control for selecting and setting the functions of an enhanced quadribalanced time display which includes seconds, minutes, hours, day name and date displays. That sequence can be readily modified to incorporate the facilitated setting of the correct AM or PM cycle described herein, using the same double numeral 8 display elements of bracket F, located in the same position below the hours display as in the figures of this application.

The present invention can also be incorporated in conventional digital time displays to achieve similar advantages of space-saving and elimination of distraction or confusion when synchronizing the display to the correct AM/PM cycle. Also, while the preferred embodiment described herein sets hours initially and thereafter the AM/PM cycle, this sequence can be reversed by initially presenting the AM/PM display for setting, followed by the correct value of the hour.

Thus, this invention achieves several important advantages. First, setting of hours is preferably accomplished by viewing and choosing only a single parameter, its value, without the distraction of a simultaneously displayed different AM/PM function. Additional scrolling through hours, after the correct real or alarm time value has been chosen, to reach a simultaneously displayed correct AM or PM cycle, and the corresponding complexity or confusion and redundancy of effort, are eliminated. Finally, initiation of flashing of the AM or PM indicator for separate setting involves only one of two choices, either the displayed cycle will be correct and need not be changed, or may have to be changed, for example, to set a wake up AM time while setting that alarm time in the afternoon. That change can be accomplished with a single manipulation of the setting control, without viewing or having to alter the previously set hour value.

The present invention has been described above in terms of its functional principles and preferred illustrative embodiments. Many variations of such disclosure will be evident to those skilled in the art. Accordingly, it should be understood that the following claims are intended to cover all changes and modifications of the illustrative embodiments which fall within the literal scope of the claims and all equivalents thereof.

The following is claimed:

1. In a digital time display, a facilitated AM/PM hour setting system which comprises:

(a) a pair of activatable multiple digital display elements grouped in two arrays;

(i) one array being alternatively activatable to display values of tens of seconds or the letter "A" or "P";

(ii) the other array being alternatively activatable to display values of units of seconds or the letter "M";

(b) means for activating the two arrays to display values of seconds;

(c) means for activating the two arrays to display one or the other of AM or PM indicators to enable selection of one or the other as a chosen 12-hour cycle of a 24-hour day;

whereby the AM or PM indicator means may be activated to synchronize a set hour value in the display to a chosen correct 12-hour AM or PM cycle from the same display position as where the values of seconds are displayed.

2. A system according to claim 1 wherein the display elements of the one array comprise at least seven elements arranged in a numeral 8 pattern, and the display elements of the other array comprise at least seven elements arranged in a numeral 8 pattern, with additional elements in the upper enclosed space of the numeral 8 pattern to enable a display of the letter "M".

3. A system according to claim 2 wherein the additional elements comprise two elements extending downwardly and convergingly from the upper corners of the enclosed space to form the middle V portion of the letter "M".

4. A system according to claim 3 incorporated in an enhanced quadribalanced time display wherein the seconds value means are activated to display 0 to 59 incrementing values of seconds during each minute of the first half hour, and to display 59 to 0 decrementing values of seconds during each minute of the second half hour.

5. A system according to claim 4 further comprising an activatable alarm indicator located above the set hour display.

6. A system according to claim 5 wherein the alarm indicator is a bell-shape icon.

7. In a digital time display, a method for facilitating AM/PM setting of hours which comprises:

(a) providing multiple digital display elements which are alternatively activatable to display digital values of seconds, or AM or PM indicators;

(b) activating the display elements to display values of seconds while the display is operating to show real time;

(c) activating the display elements to display an AM or PM indicator while the display is in a mode that enables the setting of hour values;

whereby a set hour value may be synchronized to a chosen correct 12-hour AM or PM cycle of a 24-hour day from the same display position as where the values of seconds are displayed during real time.

8. A method according to claim 7 further including the step of separately continuing the counting of the seconds values while the display is displaying the AM or PM indicator, and upon deactivation of the AM/PM indicators, resuming the display of seconds in the display beginning with the next incremental value after such deactivation.

9. A method according to claim 7 in combination with a method of displaying enhanced quadribalanced time.

10. A method according to claim 9 performed by displaying 0 to 59 incrementing values of seconds during each minute of the first half hour, and 59 to 0 decrementing seconds during each minute of the second half hour.

11. A method according to claim 9 including the step of displaying an alarm indicator above the set hour value.

12. A method according to claim 11 wherein the alarm indicator comprises a bell-shape icon.

13. A method according to claim 7 wherein the AM or PM indicator is activated after the hour value is set.

14. A method according to claim 7 wherein the AM or PM indicator is activated before the hour value is set.

15. A method according to claim 10 including the step of displaying an alarm indicator above the set hour value.

16. A method according to claim 15 wherein the alarm indicator comprises a bell-shape icon.

* * * * *